US006273775B1

(12) United States Patent
Mueller et al.

(10) Patent No.: US 6,273,775 B1
(45) Date of Patent: Aug. 14, 2001

(54) METHOD FOR DESIGNING AN IMPROVED ILLUMINATED SIGN

(75) Inventors: Lance Mueller, Rte. 3 Box 103K, Road 251, Milton, DE (US) 19979; Patrick F. Gleeson, Viola, DE (US)

(73) Assignee: Lance Mueller, Milton, DE (US)

( * ) Notice: Subject to any disclaimer, the term of this patent is extended or adjusted under 35 U.S.C. 154(b) by 0 days.

(21) Appl. No.: 09/656,033

(22) Filed: Sep. 6, 2000

Related U.S. Application Data

(62) Division of application No. 09/199,851, filed on Nov. 25, 1998

(60) Provisional application No. 60/067,445, filed on Dec. 4, 1997.

(51) Int. Cl.[7] ..... G09F 13/04

(52) U.S. Cl. ..... 445/22

(58) Field of Search ..... 445/22

(56) References Cited

U.S. PATENT DOCUMENTS

| | | | |
|---|---|---|---|
| 1,813,759 | 7/1931 | Peters . | |
| 2,046,044 | 6/1936 | Vissing | 40/130 |
| 2,057,064 | 10/1936 | Shively et al. | 40/132 |
| 2,080,679 | 5/1937 | Vissing | 40/132 |
| 2,090,989 | 8/1937 | Van Deventer et al. | 40/132 |
| 2,094,436 | 9/1937 | Van Deventer et al. | 40/132 |
| 2,118,385 | 5/1938 | Shively | 40/132 |
| 4,642,741 | 2/1987 | Cohn | 362/320 |
| 5,237,766 | 8/1993 | Milolay | 40/464 |
| 5,253,151 | 10/1993 | Mepham et al. | 362/216 |
| 5,509,223 | 4/1996 | Jung | 40/564 |
| 5,533,286 | 7/1996 | Fallon et al. | 40/545 |
| 5,539,622 | 7/1996 | Ishikaw | 362/16 |
| 5,570,947 | 11/1996 | Felland | 362/148 |
| 5,966,856 | 10/1999 | Alu | 40/564 |

*Primary Examiner*—Kenneth J. Ramsey
(74) *Attorney, Agent, or Firm*—Ratner & Prestia

(57) ABSTRACT

A method of designing an illuminated grid sign designed to be viewed at a maximum viewing angle (α) from a horizontal line of sight of an observer. The method comprises selecting the maximum viewing angle (α), selecting the illuminated tubing with inside radius (r), determining the minimum distance (d) between the tubing and the reflective channel, and designing the substantially semi-cylindrical reflective channels to have a radius (R) approximately equal to 80% to 120% of r×(1+1/(sin α))+d and an angle of wrap (β) no greater than about 180°. The design method provides a sign that minimizes visible streaks of brighter and less-bright illuminated regions in the sign when viewed from an angle less than or equal to the maximum viewing angle (α).

16 Claims, 3 Drawing Sheets

METHOD FOR DESIGNING AN IMPROVED ILLUMINATED SIGN

CROSS-REFERENCE TO RELATED APPLICATION

This application is a division of application Ser. No. 09/199,851, filed Nov. 25, 1998, status pending, which claims priority based on United States Provisional Application Number 60/067,445 filed Dec. 4, 1997.

TECHNICAL FIELD

This invention relates to an improved illuminated sign, and, more specifically to an improved neon grid sign and method for designing a neon grid sign that can be read from a variety of angles without a visible presence of undesirable streaks in the sign lettering illumination.

BACKGROUND OF THE INVENTION

Illuminated signs are used throughout the world to convey information to passers-by. Neon is often chosen for such illuminated signs because of the distinctive, brilliant color it emits. Traditionally, neon has been used in the form where tubing is bent into the shape of a word. Manufacture of this type of sign requires the frequently costly services of a skilled glass tube bender. Such signs are also limited in that once they have been created at considerable expense, they cannot be modified.

Referring now to FIGS. 1 and 2, there are depicted a partial-cutaway plan view and a cross-sectional side view of an illuminated sign, known as a neon grid sign, described generally in several early U.S. patents (for example, U.S. Pat. No. 1,813,759 to Thomas Peters, U.S. Pat. No. 2,080,679 to E. D. Vissing, U.S. Pat. No. 2,094,436 to H. R. VanDeventer et al., U.S. Pat. No. 2,046,044 to R. A. Vissing, and U.S. Pat. No. 2,118,385 to J. J. Shively). Such signs are not prevalent in commerce today. Sign 10 comprises essentially a sign frame 14 having a width "W" in which are located lengthwise sections of luminous tubing 12 parallel to the width and providing illumination. The sign frame is covered by a sign face 18 having transparent letters 11 outlined by an opaque background 13.

Luminous tubing 12 has a small diameter relative to the sign box width, and thus may be bent in alternating 180-degree curves into an S-shaped pattern with lengthwise sections 15 between curves 42 to provide illumination over the complete sign width, as shown in FIG. 1. The luminous tubing 12 is electrically attached to an electrical transformer 16. To provide a uniform appearance of light instead of a series of lines, the tubing may be mounted within curved, reflective channels 20 that have a mirrored surface.

A neon grid signs offers an advantage over signs comprising merely a neon tube bent into the shape of a word, in that a single sign frame 14 may be used with multiple or modifiable sign faces 18 to change the text of the sign as desired. The neon grid signs as described in the aforementioned references have a disadvantage, however, in that from certain angles between the viewer and the sign, the light shining through the letters forms a streaked pattern, as depicted in FIG. 3, that make the message on the sign difficult to read. Depending upon the quality of the reflectors behind the tubing, this streaked pattern may appear as a series of dark lines, or may comprise stripes of greater and lesser brightness.

The unilluminated ridges 22 between reflective channels 20 may contribute to the streaked pattern. A key factor in the creation of the streaked pattern is that the curvature of the reflector 20 may not reflect light back to the viewer 30 from the tubing 12 at certain viewing angles $\gamma$, as shown in FIG. 4, but instead reflects the lesser light coming from the direction of the viewer.

Some of the references disclosed above discuss ways to address this problem. Patent '759 describes a neon grid sign where the grid of neon tubing stands alone as the source of light, and where the pattern produced by either a single grid of one color, or multiple grids of more than one color is part of the effect desired. In such a pattern, the changes in color or light intensity are desired, so the issue of uniform light is not addressed.

Patent '679 describes the presence of metallic reflectors similar to reflectors 20 that reflect the light from the neon tubing in what is "practically a sheet of light". Patent '679 also describes, however, some presence of dark lines or reduced light reflection efficiency associated with each reflector embodiment. Significantly, patent '679 also refers to means for angling the sign to enable the sign to be more easily read when the observer is above or below the sign, implying that the illumination quality may suffer when the sign is at a vertical angle from the viewer.

Patent '436 purports to provide a sheet of neon "substantially free of the objectionable streaks and of uniform over-all brilliancy"; however, the reference provides no detail regarding the geometry of the reflectors, so that this claim can be verified. Additionally, the patent claims adjustable means for tilting the sign face at various angles, again suggesting that the sign may have required angular adjustment to facilitate streak-free viewing at certain angles.

Patent '044 describes an improvement in the form of a gap in the reflector that was necessary to prevent electrical buzzing from occurring as a result of current leakage from the bulbs to the metal reflectors.

Patent '385 describes a neon grid sign that uses a sheet of ribbed glass or other diffusion plate to help eliminate the streaked pattern. Such a diffusion plate, however, necessarily also dims the brightness of the light visible to the viewer. Thus, some of the color and brilliance that makes neon a desirable light source may be lost.

The continued pursuit of a neon grid sign free of the undesirable streaked pattern in the 1930's and the dearth of such signs in commercial use today are testimony to the desirability and elusive nature of a sign that eliminates the streaked pattern. The present invention provides a neon grid sign and method for designing such a sign that optimizes the dimensional properties of the reflector channels to eliminate, without a diffusion plate, the streaked pattern even when the sign is viewed from a vertical angle, the reflector channel design being adaptable to the largest viewing angle of the intended viewer.

SUMMARY OF THE INVENTION

In accordance with this invention, there is provided an illuminated grid sign designed to be viewed at a maximum viewing angle ($\alpha$) from a horizontal line of sight of an observer, the sign comprising:

- a frame having a width;
- a partially transparent face supported thereon;
- a plurality of lengthwise sections of luminous tubing mounted in the frame and having a tubing inside radius (r) and an inside surface having a reflector-closest edge, and;
- a plurality of concavely-curved, reflective channels each having an angle of wrap ($\beta$) and a concave surface having a tubing-closest edge positioned at a minimum distance (d) from the tubing inner surface reflector-closest edge;

wherein the improvement comprises each channel having a substantially semi-cylindrical shape with a radius of curvature (R) approximately equal to 120% of $r\times(1+1/(\sin\alpha))+d$, or less.

The invention also comprises a method for designing an illuminated grid sign having illuminated tubing and a plurality of reflective channels therein, the method comprising:

determining a maximum viewing angle ($\alpha$) from a horizontal line of sight of an observer to the sign;

selecting the illuminated tubing, said tubing having an inside radius (r);

determining a minimum distance (d) between the tubing inside radius and the reflective channel adjacent thereto; and designing the reflective channels to be substantially semi-cylindrical in shape with a radius of curvature (R) approximately equal to 120% of $r\times(+1/(\sin\alpha))+d$, or less.

The method may further comprise selecting an angle of wrap ($\beta$), no greater than 180 degrees, for the reflective channels that minimizes visible streaks of brighter and less-brighter regions in the sign when viewed from the maximum viewing angle ($\alpha$), or less.

DETAILED DESCRIPTION OF INVENTION

The invention will next be illustrated with reference to the figures wherein similar numbers indicate the same elements in all figures. Such figures are intended to be illustrative rather than limiting and are included herewith to facilitate the explanation of the apparatus of the present invention.

Figure 1:
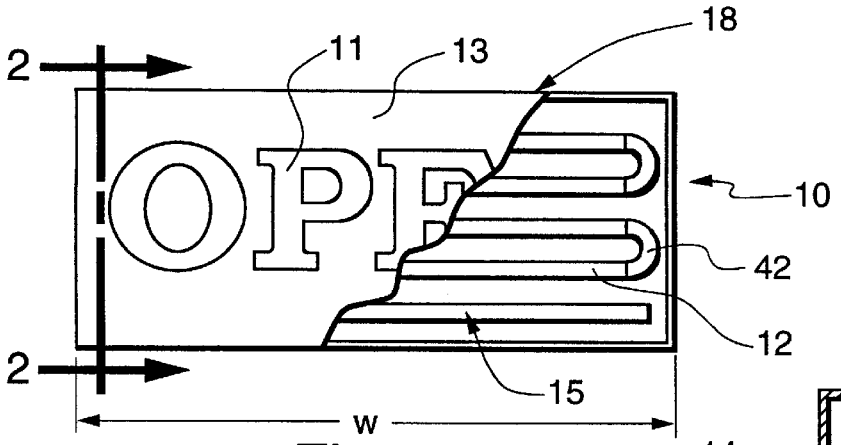
FIG. 1 is an illustration of a front view of a typical neon grid sign with a partial cutaway to show the luminous tubing behind the transparent face.
Figure 2:
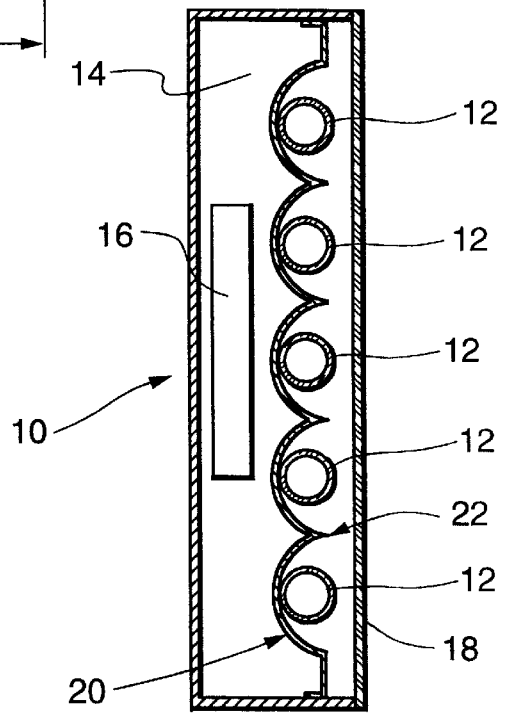
FIG. 2 is an illustration of a side view cross section of the neon grid sign of FIG. 1.
Figure 4:
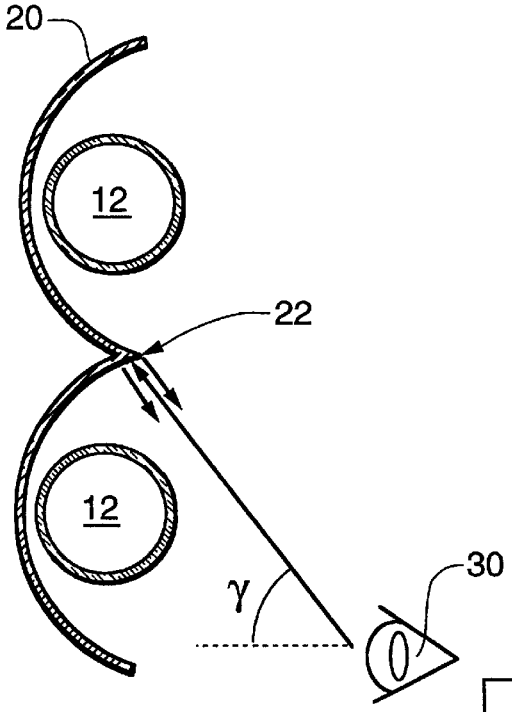
Fig. 4 (PRIOR ART)
FIG. 4 is an illustration of a side view cross section of a reflective channel of the prior art that allows a viewer to see his or her own reflection in the reflective channel, thus creating the line effect.
Figure 5:
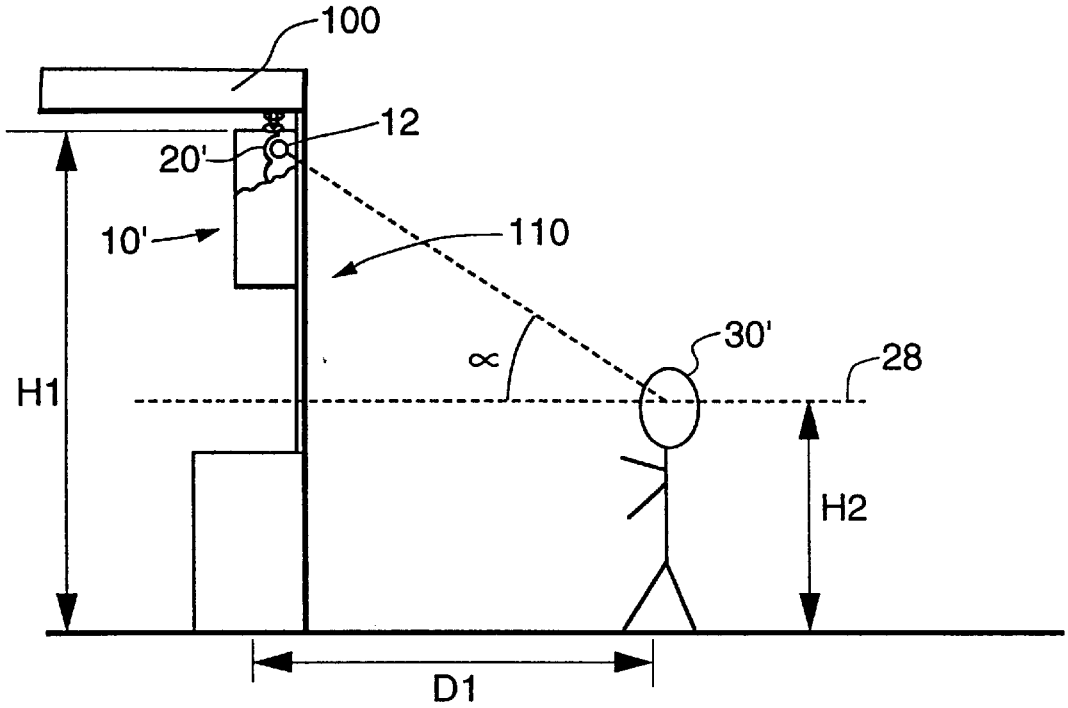
FIG. 5 is an illustration of a side view of a sign in cutaway cross-section and a viewer, showing the distances that determine the maximum viewing angle.
Figure 6:
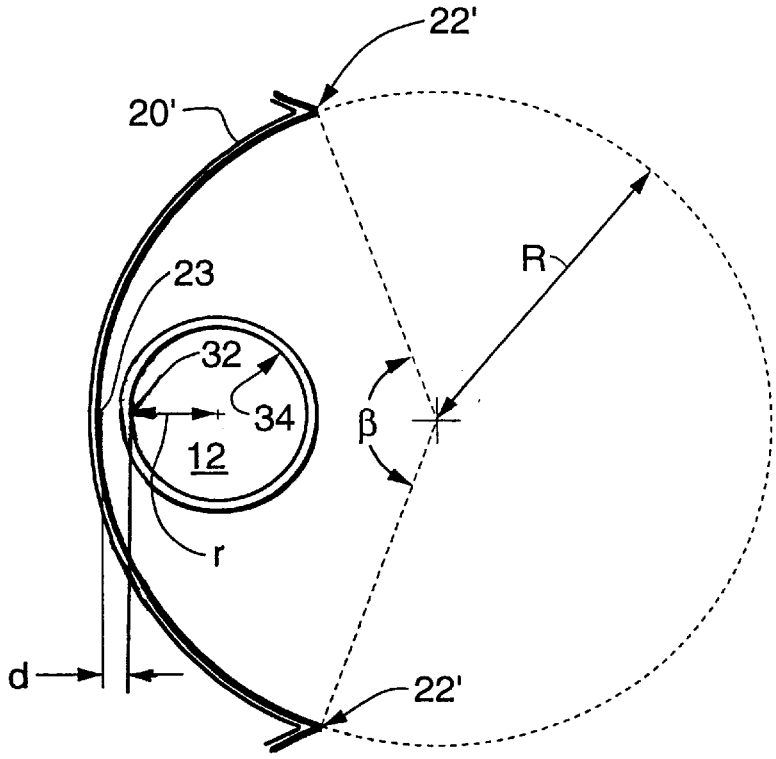
FIG. 6 is an illustration of a side view cross section of a reflective channel and luminous tubing therein, showing the critical relationships between components in accordance with the present invention.

Referring now to FIGS. 5 and 6, there are shown the specific relationships among the various sign components according to the present invention with respect to the general configuration of a neon grid sign as shown in FIGS. 1 and 2. In both the present invention and in the reference patents cited herein, a neon grid sign 10, as shown in FIGS. 1 and 2, generally comprises a frame 14 having a width (W), and a sign face 18 supported thereon and adapted to present display matter, shown here as transparent letters 11 on an opaque background 13. A plurality of lengthwise sections 15 of luminous tubing 12 is mounted therein, each section having a length parallel to the frame width (W), and each section mounted within a reflective channel 20.

A neon grid sign 10' is generally installed at a fixed height, as shown in FIG. 5 suspended from the ceiling 100 in a storefront window 110. People of varying heights and from varying distances to the sign create different angles of viewing the sign. Because of these angles, and because the sign stays stationary, the curvature of reflective channel 20' behind luminous tubing 12 is critical.

Thus, the curvature of the reflective channel 20' in sign 10' is designed for the maximum viewing angle ($\alpha$) from a horizontal line of sight 28 of a smallest average viewer 30' as shown in FIG. 5, and therefore the sign will be adequate for all lesser viewing angles. In general, this maximum viewing angle $\alpha$ is determined by the minimum viewer distance D1 from which the smallest average viewer 30' can reasonably read the sign 10' and the highest elevation H1 of design matter on the sign with respect to a first elevation H2 of the eyes of the smallest average viewer. For instance, a viewer 30' having eyes positioned on a line of sight 28 at a height H2 of 4½ feet off the ground, and who is standing at a distance D1 of 5 feet from a sign that has a height H1 of 9 feet, will have a maximum viewing angle of approximately 40° ($\arctan(H1-H2)/D1=\arctan(9-4.5)/5=42°$).

Although the figure illustrates a viewing angle where the sign is suspended above the eye elevation of an intended viewer, the maximum viewing angle $\alpha$ may also be drawn to a sign that is located at an elevation below the eyes of the intended viewer.

As shown in FIG. 6, tubing 12 also has a reflector-closest edge 32 on tubing inner surface 34, and a tubing inner radius (r). The concavely-curved, substantially semi-cylindrical, reflective channels 20' intersect at ridges 22'. Reflector-closest edge 32 of the luminous tubing 12 is positioned at a minimum distance (d) from the tubing-closest edge 23 of channel 20'. Distance (d) is measured from the tubing inside radius because this inside radius is coated with the luminescent coating that is the source of illumination.

The members have determined that there is an unexpected relationship between reflective channel 20 radius (R), tubing 12 inner radius (r), and the distance (d) of the tubing from the reflective channel that results in a sign that minimizes the undesirable streaked pattern when viewed at maximum viewing angle $\alpha$, or less. Reflective channels 20' according to the present invention have a substantially semi-cylindrical shape with a radius of curvature (R) consistent with the following equation:

$$R=r\times(+1/(\sin\alpha))+d \quad (1)$$

where:

R=the reflective channel radius of curvature r=the tubing inside radius $\alpha$=the maximum viewing angle d=the distance between the tubing inside radius and the reflective channel, as previously defined. The actual radius (R) may be less than 120%, preferably within 80–120% of the result given by equation 1, and more preferably approximately equal to the result given by equation 1. "Substantially semi-cylindrical" as used in this specification and claims refers to a partial shell of a cylinder that may be half or less than half of a full cylinder, with a cross-section that is substantially circular, but that may also be slightly elliptical in shape. Conformance with this equation assures that reflective channels 20' reflect only the illuminated tubing 12 to the viewer, rather than additionally reflecting the generally unilluminated location from which the viewer observes the sign. This reflection of the generally unilluminated region in the direction of the viewer may cause the undesirable streaked pattern described herein when the sign is viewed from certain angles.

The use of the above equation involves certain assumptions corresponding to the most common situations where a neon grid sign may be used. For instance, it is assumed that the distance from the viewer 30' to the sign 10' is much greater than (at least 20 times larger than) the radius of curvature (R) of the reflective channels 20'. This assures that light coming from the viewer will be practically parallel upon striking the reflective channels, allowing reliable prediction of the light after reflection. Another assumption is that the channel configuration is designed such that each substantially semi-cylindrical channel 20' has an angular wrap $\beta$ of no greater than 180 degrees (i.e. the channel has a cross section that is no more than half of a circle). Optical distortions such as spherical aberrations are ignored, but is accounted for by the permissible range of the radius of curvature (R) outside of the exact value determined by equation.

The minimum distance (d) between the luminous tubing 12 inside radius and the reflective channels 20' is preferably as small as possible. Often (d) is determined by the thickness of the tubing 12 wall and a spacer/insulator of cork, silicone, or other equivalent material used in the art. For a maximum viewing angle ($\alpha$) of approximately 40°, a nominal 15 mm tube (tubing inside radius (r) of about 6.15 mm), and a radius of curvature (R) in the range of about 19 mm to about 20 mm, the minimum distance (d) is typically less than about 6 mm.

Although at a minimum distance (d)=0, the angle of wrap ($\beta$) may be 180°, as minimum distance (d) increases, the angle of wrap ($\beta$) preferably decreases to limit the potential for a viewer at certain incident angles to see reflected light that reflects around and behind the bulb without striking the bulb. In a preferred embodiment using a nominal 15 mm tube (12.3 mm actual inside diameter), the angle of wrap $\beta$ is in a range of 130–135 degrees.

Because each bulb 12 is centered within a reflective channel 20', the angle of wrap sets the distance between bulbs. Also preferably, the width of ridges 22' are no more than about ⅛" (3.2 mm), more preferably no more than about 1/32" (0.8 mm) wide, to minimize any contribution of the ridges to the aforementioned streaked pattern.

Thus, the invention also comprises a method for designing an illuminated grid sign. The method comprises determining the maximum viewing angle ($\alpha$), selecting an illuminated tubing with an inside radius (r), and determining the minimum distance (d) between the tubing inside radius and the reflective channel adjacent thereto. Finally, the substantially semi-cylindrical reflective channels are designed to have a radius of curvature (R) of about 120% of $r\times(1+1/(\sin\alpha))+d$, or less. The method may further comprise selecting an angle of wrap ($\beta$), no greater than 180°, for the reflective channels that minimizes visible streaks of brighter and less-brighter regions in the sign when viewed from the maximum viewing angle ($\alpha$) or less.

Figure 7:
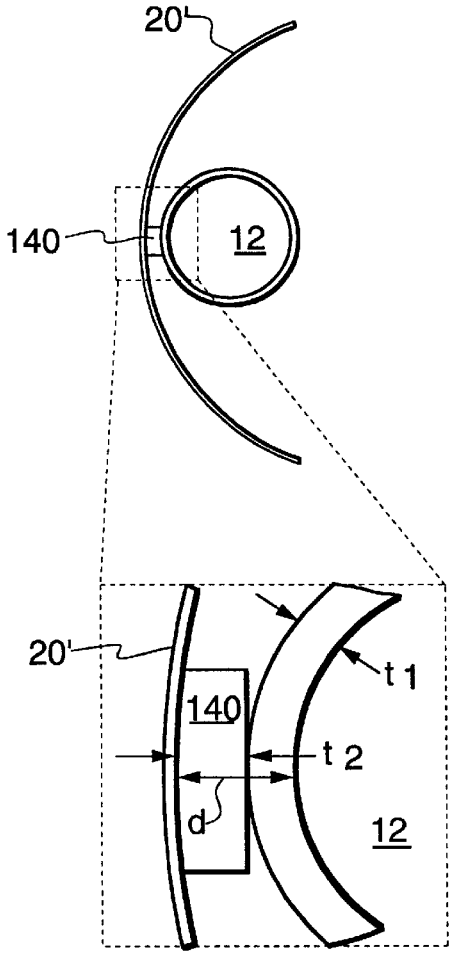
FIG. 7 is an illustration of a side view cross section of a reflective channel embodiment having a spacer behind the luminous tubing.

The reflective channels 20' may comprise a contiguous mirrored surface, may comprise a glossy white plastic, or may have a gap directly behind each section of neon tubing 12. Referring now to FIGS. 7–10, there are shown various embodiments of reflective channels 20, 120, 120', and 120" showing various ways that the luminous tubing 12 may be prevented from conducting secondary electrical current leakage to the reflector. Preferably, as shown in FIG. 7, one or more spacers 140 may be positioned at various locations across the length of tubing 12 to offset the tubing a specified distance from reflector 20.

Figure 8:
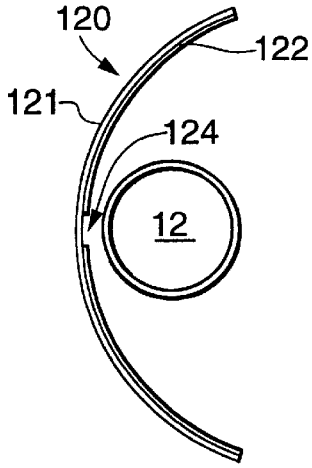
FIG. 8 is an illustration of a side view cross section of a reflective channel embodiment having a gap in the mirrored film that forms the reflective channel behind the luminous tubing.

As shown in FIG. 8, reflective channel 120 may comprise a metalized reflective film 122, such as chrome polyester, adhered to a non-conductive reflector support surface 121, such as polyvinylchloride (PVC) plastic. The reflective film 122 may have a gap 124 so that the film does not touch the luminous tubing 12.

Figure 9:
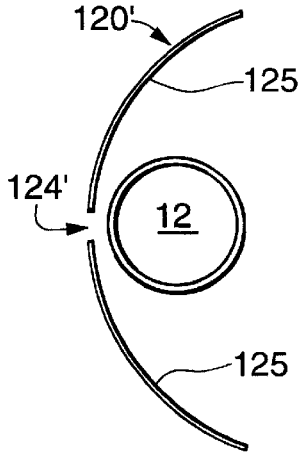
FIG. 9 is an illustration of a side view cross section of a reflective channel embodiment having a split and separated reflective channel behind the luminous tubing.
Figure 10:
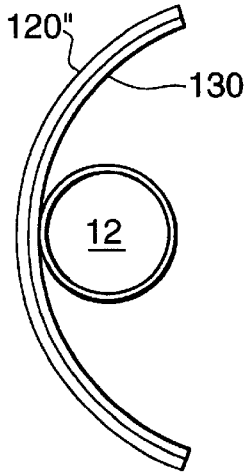
FIG. 10 is an illustration of a side view cross section of a reflective channel embodiment having a dielectric coating over the reflective channel surface between the tubing and the channel.

In an alternate embodiment, as shown in FIG. 9, the entire reflective channel 120'itself may be split and separated behind the tubing, so that the substantially semi-cylindrical channel 120' is separated into two symmetrical quadrants 125 above and below the tubing. In yet another alternate embodiment, a dielectric layer 130 may be located between the luminous tubing 12 and the reflector 120", as shown in FIG. 10.

Figure 11:
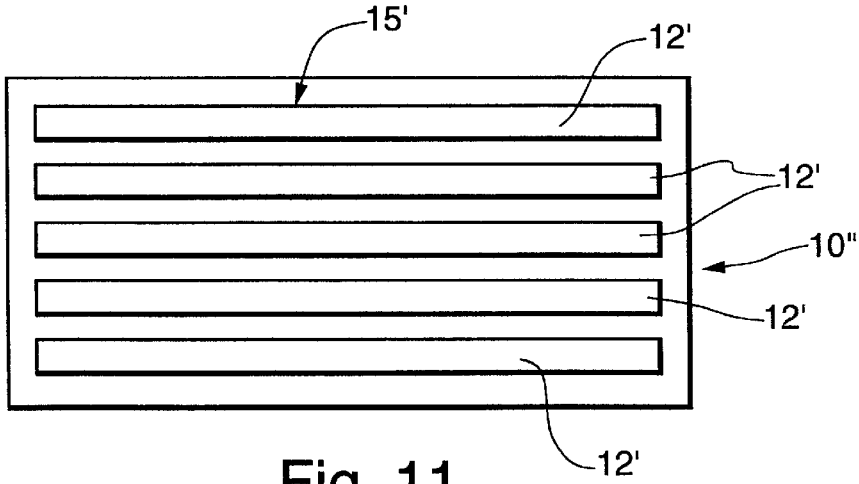
FIG. 11 is an illustration of a sign frame embodiment without the face thereon, showing a plurality of single luminous tubes therein.

The luminous tubing 12 may comprise a single neon tube repeatedly bent in alternating 180-degree curves 42 to create lengthwise sections 15 between the curves as shown in FIG. 1. Referring now the FIG. 11, there is shown an alternate exemplary embodiment of a sign 10" where the plurality of lengthwise sections 15' comprise a plurality of separate parallel neon tubes 12'.

The sign frame 14, sign face 18, transformer 16, and associated wiring, as well as the bending of the luminous tubing 12, where present, may be constructed and assembled by any methods known in the art. The sign frame may comprise a lightweight material such as plastic. Furthermore, manufacture of prototypical and commercial units in conformance with the present invention may require slight deviation from the optimum dimensions predicted by the above equations, for conformance with standard components available in the industry or to satisfy other production considerations.

Although described herein with respect to luminous neon tubing, the present invention is equally applicable to illuminated grid signs using other forms of luminous tubing, including but not limited to, fluorescent tubing.

EXAMPLE

The following example is included to more clearly demonstrate the overall nature of the invention, referring to FIGS. 5 and 7 for the enumerated components. This example is exemplary, not restrictive, of the invention.

A prototype illuminated grid sign (10), 9-inches tall by 32-inches wide, was designed to be used where the maximum viewing angle ($\alpha$) is approximately 40°. The sign was constructed using industry-standard nominal 15 mm neon tubing (12) having an actual inside diameter of about 12.3 mm (r=6.15 mm). The minimum distance (d) between the neon tubing (12) inside radius and the reflective channels (20') was approximately 4 mm, corresponding to about 1.2 mm thickness (t1) of the tubing 12 wall plus about 2.8 mm thickness (t2) of spacer 140, as shown in the magnified section of FIG. 7.

$$R=6.15\times[1+1/\sin(40^\circ)]+4=19.7\text{ mm}$$

A reflective channel diameter of 38.1 mm (about 3.3% smaller than the 39.4 mm diameter predicted by equation) was chosen to conform to a standard manufacturing size. The reflective channels were constructed of white, formed plastic (PVC) sheet with a chrome polyester mirror finish to provide the reflective surface, with an angle of wrap (β)=130 degrees.

Figure 3:
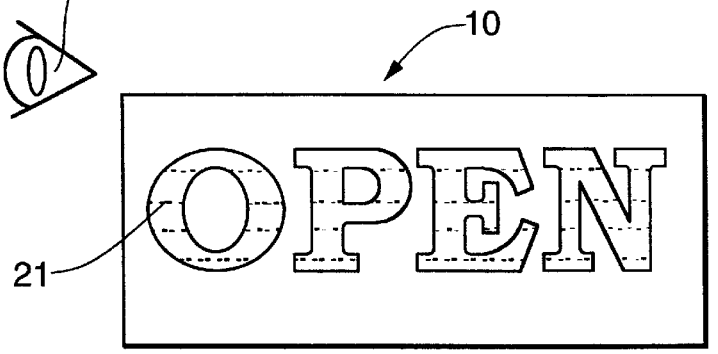
Fig. 3 (PRIOR ART)
FIG. 3 is an illustration of a front view of a neon grid sign of the prior art, depicting the undesirable streaked pattern visible to a viewer at certain angles.

The sign was viewed at various angles less than approximately 40°. The aforementioned streaked pattern, as depicted in FIG. 3 of the prior art, was not present. While the dimensions of the reflective channels in the prototype were chosen for ease of manufacturing a single unit, the manufacture of multiple commercial units is contemplated to include reflective channels having a diameter of 39.4 mm in conformance with the exact dimension calculated according to the equation disclosed herein, with an angle of wrap (β)=134 degrees, all other parameters remaining the same.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed:

1. A method for designing an illuminated grid sign having a plurality of lengthwise sections of light-emitting luminous tubing and a plurality of concavely-curved reflective channels each positioned to reflect a portion of the light emitted by one of said lengthwise sections, the method comprising:

selecting a maximum viewing angle (α) from a horizontal line of sight of an observer to the sign;

selecting the luminous tubing, said tubing having an inside radius (r) and an inner surface having a reflector-closest edge;

determining a minimum distance (d) between the tubing inner surface reflector-closest edge and a tubing-closest edge of the reflective channel adjacent thereto; and forming the reflective channels to be substantially semi-cylindrical with a radius (R) approximately equal to about 80% to about 120% of $r\times(1+1/(\sin\alpha))+d$ and an angle of wrap (β) no greater than about 180°.

2. The method according to claim 1, further comprising selecting said maximum viewing angle (α) based upon a minimum viewing distance from which a smallest average viewer having eyes at a first elevation can reasonably read design matter at a highest elevation on the sign.

3. The method according to claim 2, comprising selecting said maximum viewing angle (α) approximately equal to $\arctan((H1-H2)/D1)$, wherein H1 is said highest elevation, H2 is said first elevation, and D1 is said minimum viewing distance.

4. The method of claim 1, comprising forming the channels with the radius of curvature (R) approximately equal to $r\times(1+1/(\sin\alpha))+d$.

5. The method of claim 1 further comprising selecting luminous tubing comprising a single neon tube repeatedly bent in alternating 180 degree curves to create the lengthwise sections between the curves.

6. The method of claim 1 comprising selecting luminous tubing comprising a plurality of parallel neon or fluorescent tubes.

7. The method of claim 1 further comprising positioning each of said channels adjacent to at least one other channel to create a ridge between the adjacent channels having a width of no more than about 3.2 mm.

8. The method of claim 7 comprising positioning each of said adjacent channels such that the ridge has a width of no more than about 0.8 mm.

9. The method of claim 1 further comprising separating each of said reflective channels at the tubing-closest edge into two symmetrical quadrants spaced a sufficient distance from one another to prevent electrical leakage from the luminous tubing to said reflective channel.

10. The method of claim 1 comprising forming the plurality of reflective channels by adhering a reflective film to a non-conductive reflector support surface.

11. The method of claim 10 further comprising providing the reflective film with a gap along the tubing-closest edge of the reflective channel concave surface of sufficient width to prevent electrical leakage from the luminous tube to the reflective film.

12. The method of claim 10 further comprising coating the reflective channel with a dielectric film.

13. The method of claim 10 further comprising placing a non-conductive spacer between the luminous tubing and the reflective channel.

14. The method of claim 1 comprising forming the reflective channels from a white plastic or a white glossy plastic.

15. The method of claim 14 comprising forming each of said reflective channels with an angle of wrap (β) that is in the range of about 130° to about 135°.

16. The method of claim 1 comprising selecting values for the luminous tubing inside radius (r), the minimum distance (d), the reflective channel radius (R) and angle of wrap (β) that minimize visible streaks of brighter and less-bright illuminated regions in the sign when viewed from an angle less than or equal to the maximum viewing angle (α).

* * * * *